US005675847A

United States Patent [19]

Pierre

[11] Patent Number: 5,675,847

[45] Date of Patent: Oct. 14, 1997

[54] UNDER-SINK HOSE RETAINER

[76] Inventor: Peter Pierre, P.O. Box 876595, Wasilla, Ak. 99687

[21] Appl. No.: 685,628

[22] Filed: Jul. 24, 1996

[51] Int. Cl.[6] ..... A47K 17/00

[52] U.S. Cl. ..... 4/654; 4/638

[58] Field of Search ..... 4/654, 619, 628, 4/638

[56] References Cited

FOREIGN PATENT DOCUMENTS 6178737 6/1994 Japan ..... 4/654

*Primary Examiner*—David J. Walczak

*Attorney, Agent, or Firm*—Michael J. Tavella

[57] ABSTRACT

A hose retainer for spray hoses that uses a "U" shaped hose retainer that has a hollow interior. The hose retainer is sized to hold a fully retracted sprayer hose. The sprayer hose can be attached to a sprayer nozzle or to a removable faucet sprayer, found on modern sinks. A flange secures the hose retainer under the counter top. If needed, brackets can be installed near the bottom of the hose retainer to provide additional support. In this way, the hose can be stored within the hose retainer, removed for use, and replaced without exposing the sprayer hose to any of the under-sink plumbing or items that may be stored there.

10 Claims, 3 Drawing Sheets

UNDER-SINK HOSE RETAINER

This invention relates to hose retainers and particularly to hose retainers that installed under sinks.

BACKGROUND OF THE INVENTION

Almost every home now has a sprayer attachment installed in the kitchen sink. These sprayers are attached to the faucet by a flexible hose. This hose can be two to four feet long. In use, the sprayer head is pulled from the top of the sink, which extends the hose outward from the sink. After use, the sprayer head is replaced. The hose is pushed through a hole in the top of the sink. The hose is typically kept loose in the space under the sink. In this space, people often store items. Also, the water pipes and valves are kept in this space. Because of the items kept under the sink (including the pipes), there is a high probability that the spray hose can get caught on the pipes or other items. Pulling sharply on a caught hose may break pipes, valves or other items.

SUMMARY OF THE INVENTION

To keep the sprayer hose from getting caught, the sprayer hose needs to be kept in a protected location, where it can be removed and stored without interfering with other items stored under the sink. To this end, the instant invention is a "U" shaped hose retainer that has a hollow interior. The hose retainer is sized to hold a fully retracted hose. A flange secures the hose retainer to the lower portion of the sink or the countertop. If needed, brackets can be installed near the bottom of the hose retainer to provide additional support. The hose retainer can be used with a conventional sprayer nozzle, or the newer model faucets that have a removable faucet head that can be used as a sprayer. In this way, the hose for either type of sprayer can be stored within the hose retainer, removed for use, and replaced without exposing the hose to any of the under-sink equipment or items that may be stored there.

For convenience, the term sprayer hose here to describe both the hose used with a conventional sprayer nozzle and the hose used with the faucet type sprayer.

It is an object of this invention to provide a hose retainer for a sink sprayer hose that contains the hose to prevent contact with equipment or items that may be stored under the sink.

It is another object of this invention to provide a hose retainer for a sink sprayer hose that is simple to install.

DETAILED DESCRIPTION OF THE INVENTION

Figure 1:
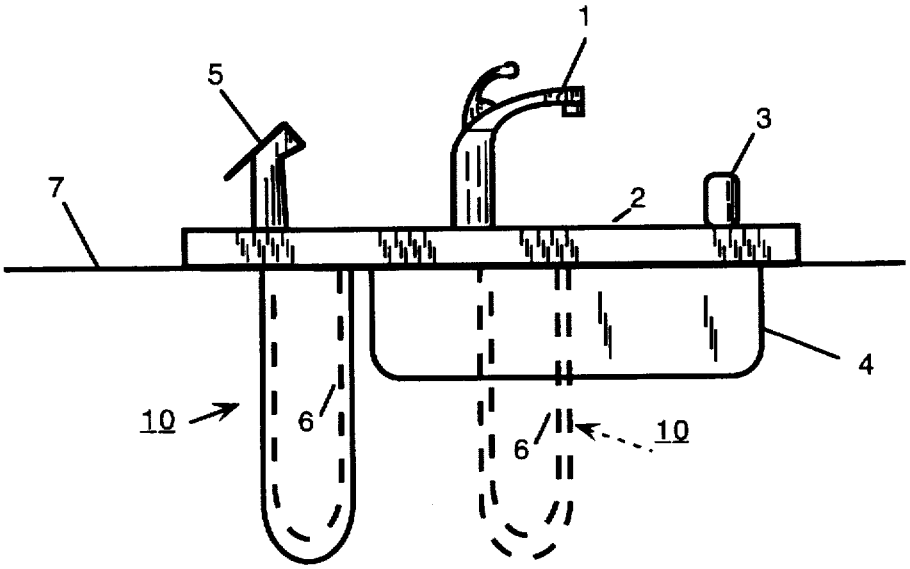
FIG. 1 is a detail view of the invention installed in a sink enclosure.

Referring now to FIG. 1, a typical sink installation using the invention is shown. As mentioned above, the term sprayer hose here to describe both the hose used with a conventional sprayer nozzle and the hose used with the faucet type sprayer.

This installation includes a faucet 1, a faucet frame 2, an air tube cover 3, a sink 4, a sprayer head 5 a sprayer hose 6, a counter top 7, and the instant invention, a hose retainer 10. Note that where the faucet 1 is removable, the sprayer head 5 is not present. Moreover, the location of the sprayer hose 6 and the hose retainer 10 is moved to be more in line with the faucet 1. This is shown in FIG. 1, by showing the hose retainer 10 in dashed lines under the faucet 1. In either location, the installation and use is the same.

Figure 2:
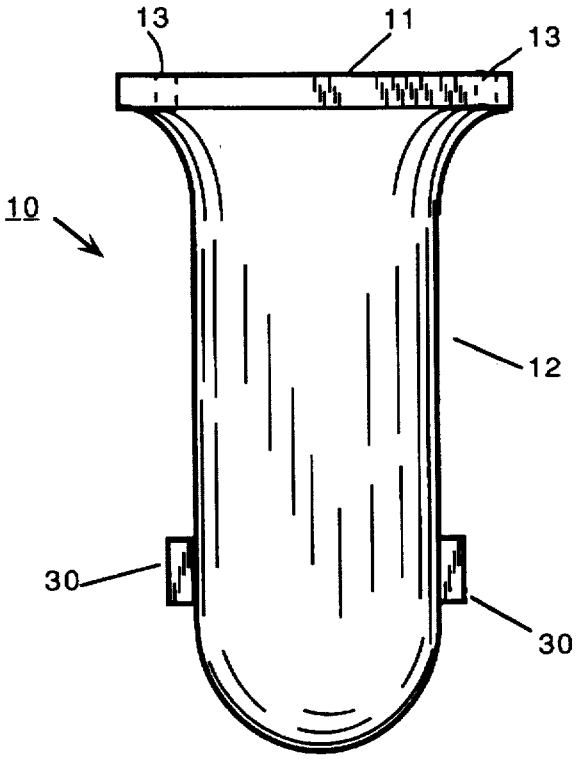
FIG. 2 is a front view of the invention.
Figure 3:
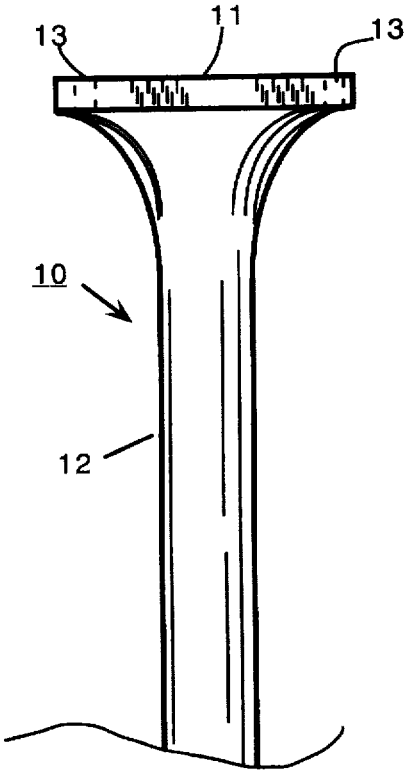
FIG. 3 is a side view of the invention.

FIG. 2 shows a front view of the invention 10. An upper flange 11 is attached to the top of the lower curved portion 12. FIG. 2 shows the lower curved portion as a solid surface container 12. The container 12 is hollow and has a width greater than its depth (see FIG. 3). FIG. 3 shows the side view of the invention. The depth of the device is designed to be large enough to hold a standard spray hose 6. By making the hose retainer 10 in this form, the hose 6 can simple slip down into the hose retainer 10 without binding or getting caught. The hose retainer 10 can be made from any suitable material such as high impact plastic or PVC, or even lightweight metals. Note that other types of mounting systems can be used besides the flange 11 mentioned above.

Figure 4:
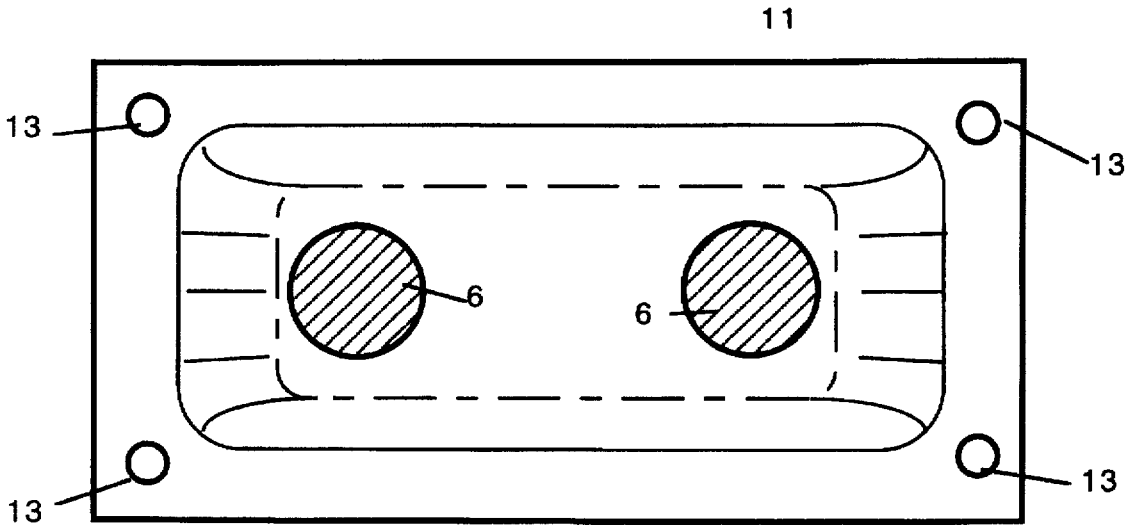
FIG. 4 is a top view of the invention, showing the placement of the hose within the hose retainer.

In the preferred embodiment, four mounting holes 13 are provided in the upper flange 11 as shown. FIG. 4 is a top view of the invention and shows the upper flange 11 and the mounting holes 13. Hose 6 is shown within the hose retainer. The invention is mounted under the counter top 7 under the sprayer head 5 (or, as mentioned above, under the faucet 1) for best alignment of the device with the spray hose 6. Bolts, screws, or other fasteners are used to connect the device to the counter top or sink 4 using means common to the plumbing arts.

Figure 5:
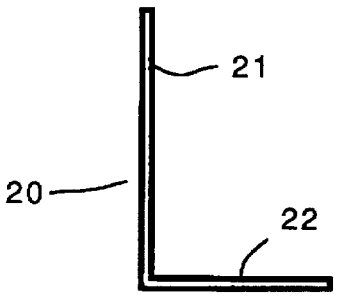
FIG. 5 is a side view of an auxiliary support bracket.
Figure 6:
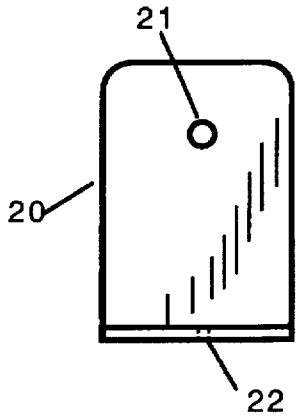
FIG. 6 is a front view of the auxiliary support bracket.
Figure 7:
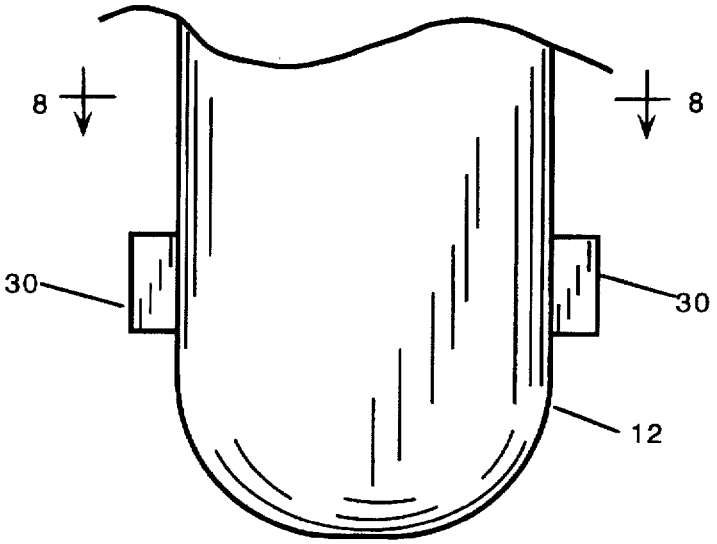
FIG. 7 is a front detail view of the lower portion of the invention showing the bracket flanges.
Figure 8:
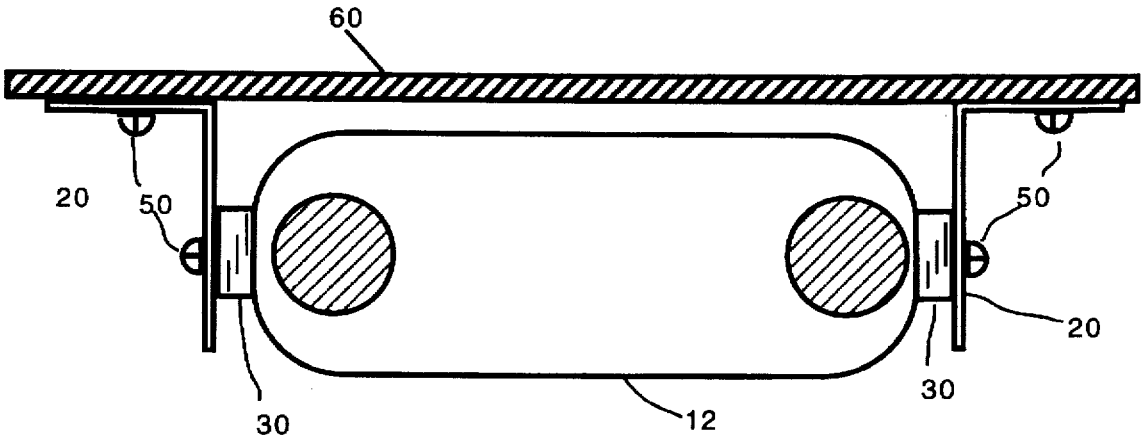
FIG. 8 is a sectional view of the invention, taken along the lines 8—8 of FIG. 7, showing the support brackets installed.

To provide additional lateral support, especially at the bottom of the hose retainer, auxiliary mounting brackets can be used. FIG. 5 is a side view of a typical bracket 20. FIG. 6 is a front view of the bracket 20. The bracket 20 has a mounting hole 21 formed in the long flange, as shown. A second mounting hole 22 is found in the short flange. The brackets 20 are mounted on bracket flanges 30 that are mounted just above the lower curved portion 12 of the hose retainer 10. See FIG. 7. FIG. 8 shows the brackets 20 mounted on the bracket flanges 30. Screws, or other fasteners 50 common to the art can be used to secure the brackets 20 to the bracket flanges 30. The brackets 20 are then attached to the rear wall of the sink cabinet 60, or other convenient mounting surface using screws, nails or other common fasteners 50 as shown. The brackets can also be installed with glue or other adhesives. However, this is not preferred because the glues make removal of the device difficult.

The spray hose 6 is typically placed within the hose retainer 10 as the hose retainer 10 is installed. Once the hose retainer 10 is installed, the user can freely use the sprayer as before, knowing there will be no difficulties with the hose 6.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A hose retainer, for holding a sprayer hose, used near a sink, comprising:

a) a counter top, having a hole formed therein to receive a sink;

b) a sink, having a faucet installed thereon;

c) a sprayer nozzle, having a hose attached thereto;

d) a hollow storage container, having a top; and e) a means for mounting said hollow storage container to said counter top such that said container is operably adjacent to said sprayer hose and such that said sprayer hose is removably placed and contained within said hollow storage container.

2. The hose retainer of claim 1 wherein said hollow storage container us a U shaped bottom.

3. The hose retainer of claim 1 wherein the means for mounting said hollow storage container to said counter top comprise a flange, fixedly attached to the top of said hollow storage container.

4. The hose retainer of claim 3 wherein said flange has at least one mounting hole formed therein.

5. The hose retainer of claim 1 further comprising:

a) at least one bracket flange, being fixedly attached to said hollow storage container; and b) at least one mounting bracket removably attached to said bracket flange.

6. A hose retainer, for holding a sprayer hose, used near a sink, comprising:

a) a counter top, having a hole formed therein to receive a sink;

b) a sink, having a faucet installed thereon;

c) a sprayer nozzle, having a hose attached thereto; having a top, and a U-shaped bottom; and e) a flange, fixedly attached to the top of said hollow storage container for mounting said hollow storage container to said counter top such that said hollow storage container is operably adjacent said sprayer hose such that said sprayer hose is removably placed and contained within said hollow storage container.

7. The hose retainer of claim 6 wherein said flange has at least one mounting hole formed therein.

8. The hose retainer of claim 6 wherein said flange has four mounting holes formed therein.

9. The hose retainer of claim 6 further comprising:

a) at least one bracket flange, being fixedly attached to said hollow storage container; and b) at least one mounting bracket removably attached to said bracket flange.

10. A hose retainer, for holding a sprayer hose, used near a sink, comprising:

a) a counter top, having a hole formed therein to receive a sink;

b) a sink, having a faucet installed thereon;

c) a sprayer nozzle, having a sprayer hose attached thereto;

d) a hollow storage container, said hollow storage container having a top, and a U-shaped bottom;

e) a flange, fixedly attached to the top of said hollow storage container for mounting said hollow storage container to said countertop such that said hollow storage container is operably adjacent said sprayer hose such that said sprayer hose is removably placed and contained within said hollow storage container, wherein said flange has four mounting holes formed therein;

f) a pair of bracket flanges, being fixedly attached to said hollow storage container, and being oppositely disposed thereon; and g) a pair of corresponding mounting brackets removably attached to said pair of bracket flanges.

* * * * *